US011123649B1

(12) United States Patent
Kownacki

(10) Patent No.: US 11,123,649 B1
(45) Date of Patent: Sep. 21, 2021

(54) MOOV FIDGET TOY

(71) Applicant: Charles D. Kownacki, Erie, PA (US)

(72) Inventor: Charles D. Kownacki, Erie, PA (US)

( * ) Notice: Subject to any disclaimer, the term of this patent is extended or adjusted under 35 U.S.C. 154(b) by 0 days.

(21) Appl. No.: 16/887,633

(22) Filed: May 29, 2020

(51) Int. Cl.
*A63H 33/00* (2006.01)

(52) U.S. Cl.
CPC ..... *A63H 33/00* (2013.01)

(58) Field of Classification Search
CPC ..... A63H 33/00; A63H 33/04; A63H 33/103; A63F 9/088; A63F 2009/1292; A63F 2250/124
USPC ..... 446/85, 117, 119, 486, 487, 490
See application file for complete search history.

(56) References Cited

U.S. PATENT DOCUMENTS 423,066 A * 3/1890 Massey ..... A63H 3/005 446/73
994,227 A * 6/1911 Whitelaw ..... A63F 9/10 273/157 R
1,960,876 A * 5/1934 Passarelli ..... A63H 3/04 446/374
2,877,506 A * 3/1959 Almoslino ..... A63H 33/107 52/223.7
3,350,811 A * 11/1967 Bender ..... A63H 33/00 446/117
3,514,893 A * 6/1970 Paksy ..... A63H 33/00 446/486
3,577,673 A * 5/1971 Monestier ..... A63H 33/105 446/490
3,597,872 A * 8/1971 Vennola ..... A63F 9/088 446/490
3,900,984 A * 8/1975 Garelick ..... A63F 9/088 446/486
4,026,065 A * 5/1977 Dick ..... A63H 33/108 446/121
4,295,832 A * 10/1981 Karell ..... A63F 9/0098 273/456
4,305,582 A * 12/1981 Barton ..... A63F 9/00 273/440
4,392,323 A * 7/1983 Rubik ..... A63H 33/103 446/487
4,509,920 A * 4/1985 Kaufmann ..... G09B 19/02 273/157 R
4,509,929 A * 4/1985 Zawitz ..... A63H 33/065 446/102
4,679,954 A * 7/1987 Ambasz ..... B43K 24/04 401/117
4,729,686 A * 3/1988 Ambasz ..... B43K 24/023 401/116
4,798,553 A * 1/1989 Gentles ..... A63H 7/06 446/287
4,820,234 A * 4/1989 Isaf ..... A63H 3/16 446/100
4,997,375 A * 3/1991 Heinz ..... A63F 9/088 434/403
5,172,534 A * 12/1992 Milner ..... A63H 33/042 446/104

(Continued)

*Primary Examiner* — Alexander R Niconovich
(74) *Attorney, Agent, or Firm* — Richard K Thomson

(57) ABSTRACT

A fidget toy includes a plurality of wedge-shaped segments having bosses which interconnect the segments. Bearings allow adjacent segments to rotate relative to each other. Exertion of pressure on the top and bottom surfaces with a wiggling between respective sets of fingers, induces a dancing movement of the fidget toy.

6 Claims, 5 Drawing Sheets

(56) References Cited

U.S. PATENT DOCUMENTS 5,302,148 A * 4/1994 Heinz ..... A63F 9/088 273/153 S
5,395,245 A * 3/1995 Heinz ..... G06C 1/00 223/48
5,584,195 A * 12/1996 Liu ..... A44C 5/0007 401/131
5,836,802 A * 11/1998 Harnett ..... A63H 3/46 446/367
5,989,099 A * 11/1999 Arnold, III ..... A63H 33/00 434/112
6,086,445 A * 7/2000 Zawitz ..... B43K 5/005 242/588.1
6,158,914 A * 12/2000 Junkins ..... B43K 5/005 401/195
6,190,228 B1 * 2/2001 Hoogenboom ..... A63H 33/00 446/117
6,241,572 B1 * 6/2001 Braginsky ..... A63F 9/088 434/211
6,612,766 B2 * 9/2003 Collins ..... B43K 7/005 401/195
7,192,328 B2 * 3/2007 Zawitz ..... A63H 33/00 446/102
7,774,963 B2 * 8/2010 Puglisi ..... G09F 23/00 40/334
8,496,483 B1 * 7/2013 Walters ..... G09B 1/14 434/172
9,789,727 B1 * 10/2017 Phillips ..... B43K 29/00
10,575,604 B2 * 3/2020 Kimbrough ..... A44C 15/001
10,966,898 B2 * 4/2021 Nichols ..... A63B 21/072
2006/0280545 A1 * 12/2006 Zawitz ..... B43K 5/005 401/6
2007/0041780 A1 * 2/2007 Hsu ..... B43K 7/005 401/195
2019/0038499 A1 * 2/2019 Horowitz ..... A61H 7/003
2019/0083894 A1 * 3/2019 Zhang ..... A63H 33/04
2019/0105578 A1 * 4/2019 Brous ..... A63H 33/00

* cited by examiner

MOOV FIDGET TOY

BACKGROUND AND SUMMARY OF THE INVENTION

The present invention is directed to the field of stress relief toys, also called "fidget toys". More particularly, the present invention is directed to a fidget toy particularly adept at stress relief.

Our society has become increasingly "stress producing" which has a negative impact on actual work production, mental peace of mind and interpersonal relationships. As a result, there has recently been an attempt to address these issues with a variety of different stress relieving devices in the form of "fidget toys".

The user of the present "Moov™" fidget toy finds her/himself drawn to use the device, virtually compelled to pick it up and utilize it for its calming influence, or, if not specifically to garner that benefit, to produce the wiggling movement that results from wrestling with the device. The stress relief necessarily follows as a by-product.

The present invention is a stress-relieving fidget toy comprising: a) a first plurality $P_1$ of interconnected wedge segments including an uppermost and a lowermost interconnected wedge segment and a second plurality $P_2$ of intermediate interconnected wedge segments; b) connection means extending between adjacent ones of the first plurality of interconnected wedge segments; c) circular bearing means surrounding each of the connection means; whereby exertion of opposing pressure on an uppermost and lowermost surface of the uppermost and the lowermost interconnected wedge segments will cause random rotation of said second plurality of intermediate wedge segments which in turn results in a serpentine wiggling of the first plurality of interconnected wedge segments.

Preferably each of said second plurality $P_2$ of wedge segments has a wedge-included-angle $\alpha$ of between 15° and 25°. It can also, in some embodiments, be beneficial for the uppermost and lowermost segments to have a combined wedge-included-angle of $\alpha$. In those instances, $(P_2+1)\alpha \leq 82°$. For some embodiments, each of the first plurality $P_1$ of interconnected wedge segments is hexagonal in shape. In other versions, each of the first plurality $P_1$ of interconnected wedge segments is round in shape. Other configurations (pentagon, octagon, etc.) are also possible.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figures 1, 1A, 1B:
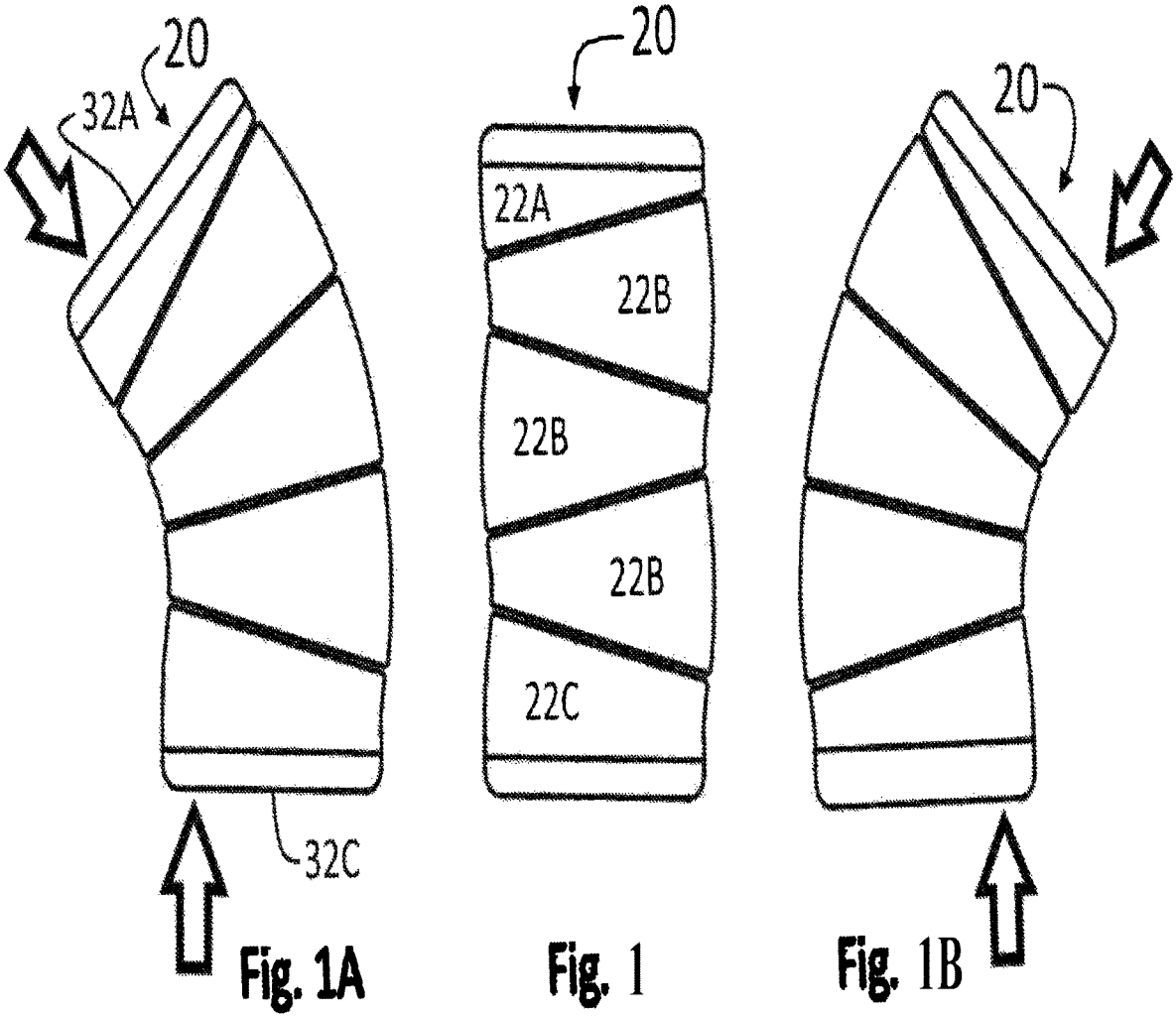
FIG. 1 is a front view of a first embodiment of the Moov fidget toy of the present invention.
FIG. 1A is a front view with the segments in an alternate position.
FIG. 1B is a front view with the segments in an opposite alternate position.
Figures 2A, 2B, 2C, 2D:
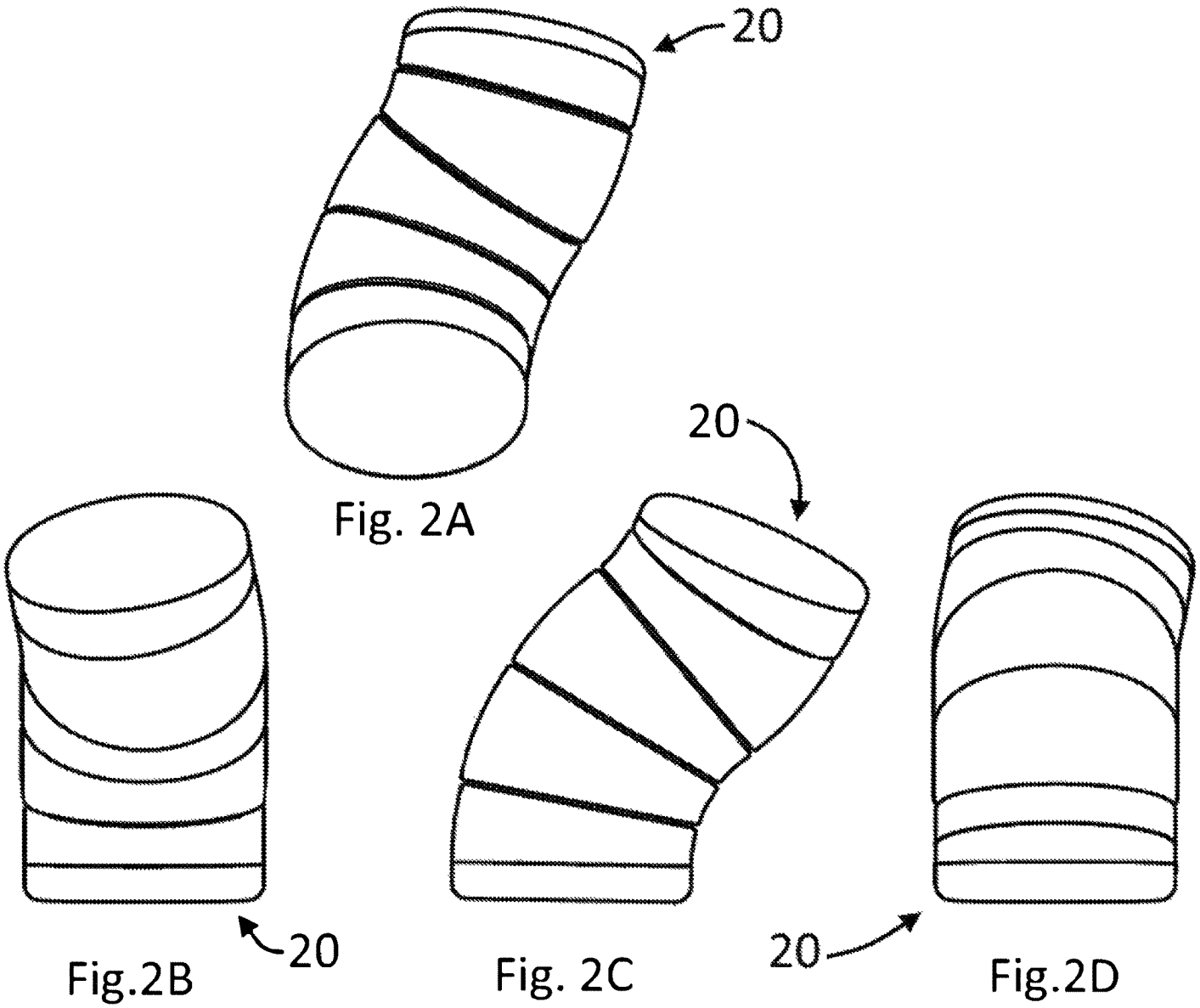
FIG. 2A is a schematic perspective view with the segments in a first position.
FIG. 2B is a front schematic view with the segments in the first position.
FIG. 2C is a side schematic view with the segments in the first position.
FIG. 2D is a rear schematic view with the segments in the first position.

A first embodiment of the Moov™ fidget toy of the present invention is depicted in FIGS. 1-4 generally at 20. As best seen in FIGS. 1, 1A, 1B, fidget toy 20 is comprised of a first plurality of segments 22, the end segments labeled 22A and 22C with a second plurality of center segments labeled 22B. The overall total number of interconnected wedge shaped segments is $P_1$ (in this embodiment, 5) while the number of intermediate wedge-shaped segments is $P_2$ (in this embodiment, 3). The second plurality of center segments 22B each has a wedge-included-angle $\alpha$ that is preferably between 15° and 25°, while the upper and lower end segments 22A and 22C will most preferably have wedge-included-angles of $0.5\alpha$.

Figure 3:
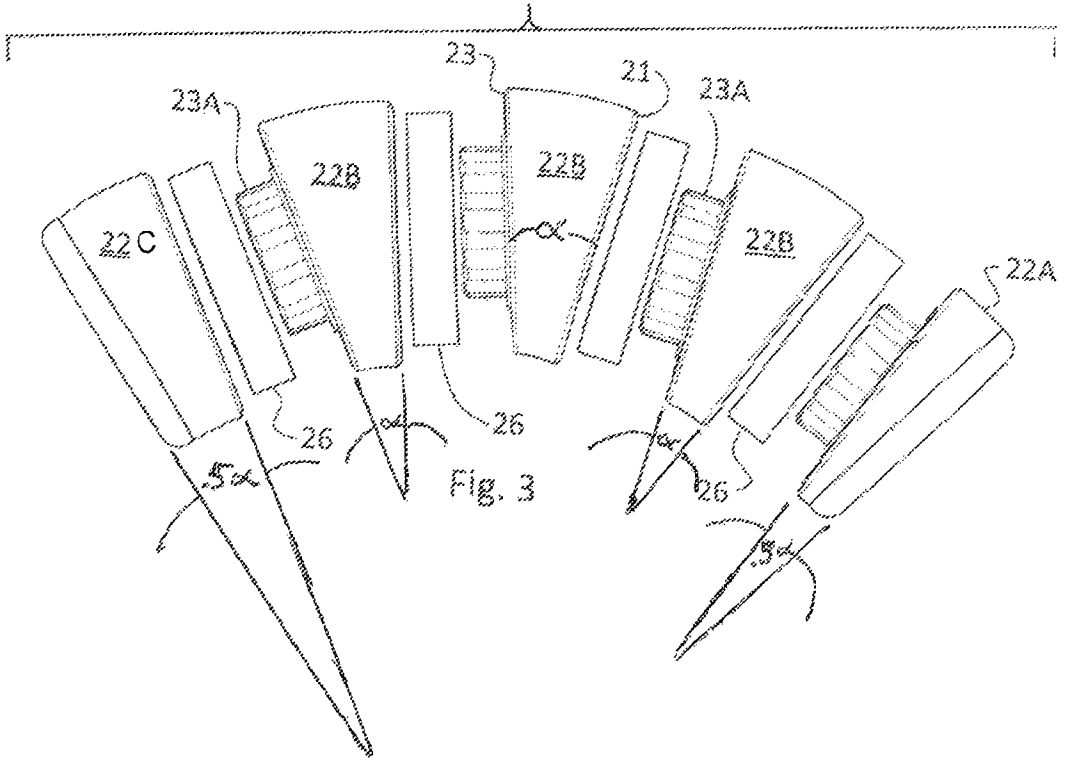
FIG. 3 is an exploded view of the first embodiment.
Figure 4:
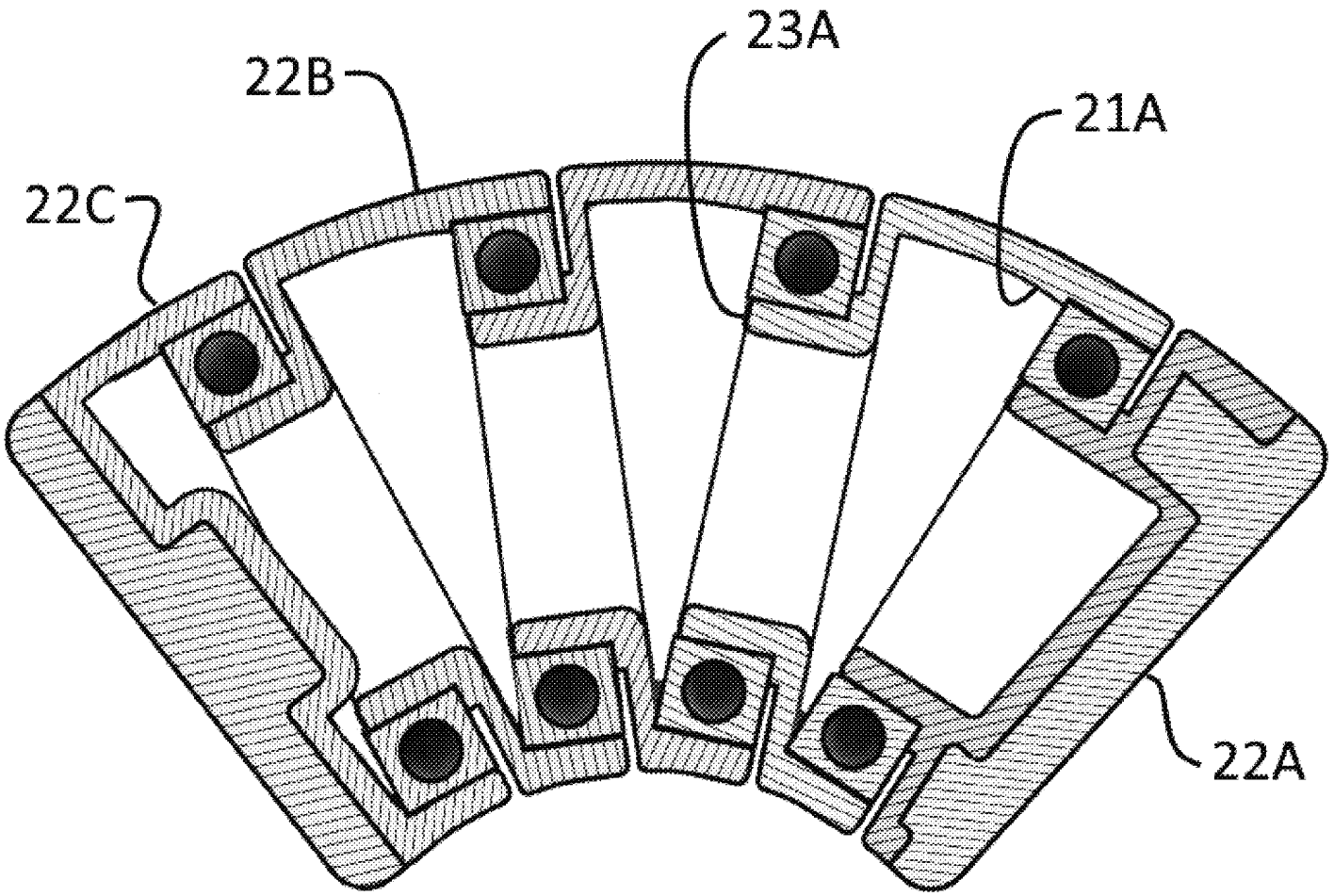
FIG. 4 is a cross-sectional view of the first embodiment.
Figure 5C:
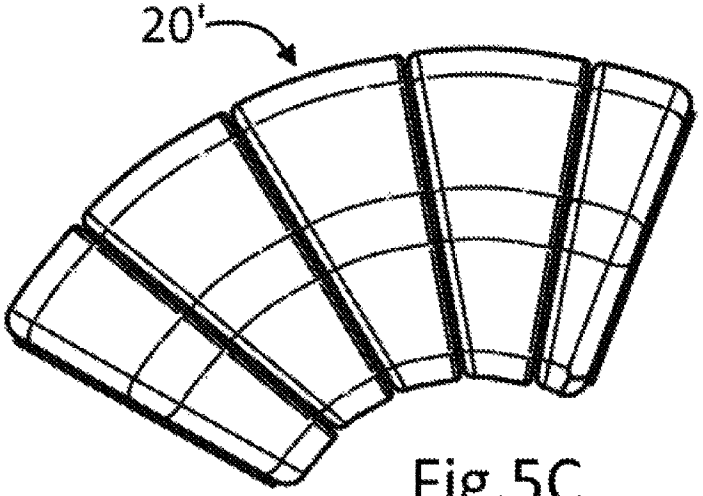
FIG. 5C is a side schematic view of the second embodiment.
Figure 5D:
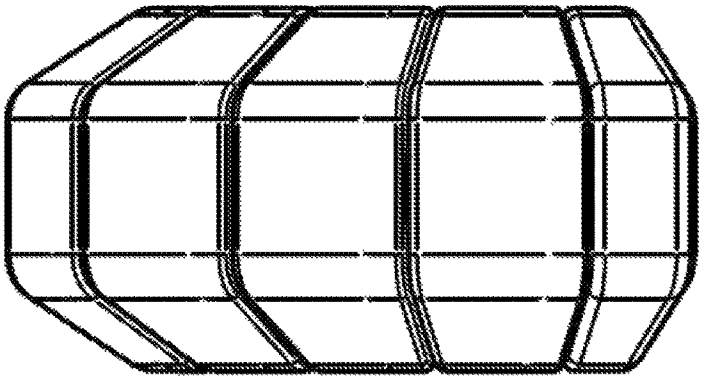
FIG. 5D is a top schematic view of the second embodiment.
Figure 5B:
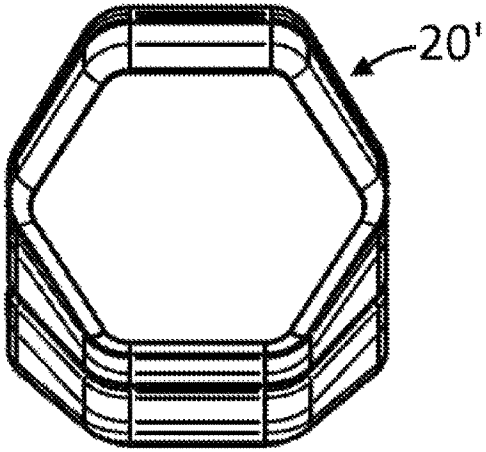
FIG. 5B is a front schematic view of the second embodiment.
Figure 5A:
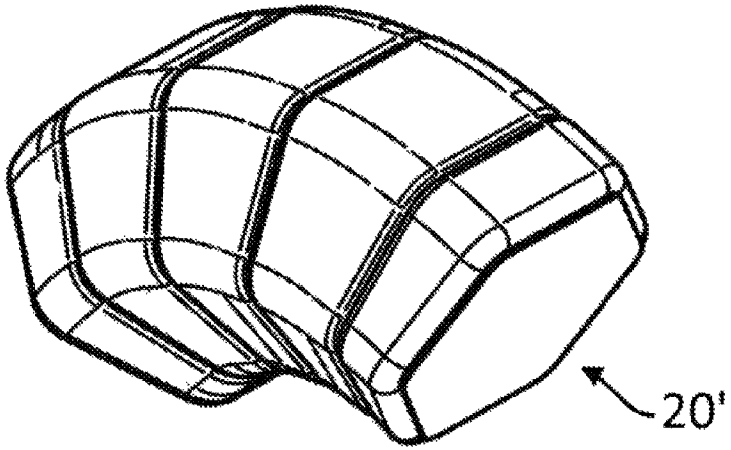
FIG. 5A is a schematic perspective view of a second embodiment of the Moov fidget toy of the present invention.

As best seen in FIGS. 3, 4, each intermediate segment 22B has a first end 21 with an opening 21A therein and a second end 23 with a boss or connecting means 23A that serves to connect adjacent segments 22. Circular bearing means 26 are positioned between each of the rotatable wedge segments 22. As shown in FIG. 4, each circular bearing means 26 is press fit and/or glued into opening 21A in adjacent segment 22B. Connecting means 23A is press fit into its associated circular bearing means 26.

As shown in FIGS. 1, 1A, 1B by putting axial pressure on upper surface 32A of upper segment 22A and lower surface 32C of lower segment 22C, with a little "wiggle motion" from the opposing fingers, the segments 22 with dance from a position shown in FIG. 1 in which the alignment essentially forms a cylinder, to one of the slumping cylinders shown in FIGS. 1A and 1B, and a variety of configurations in between. It will be noted in FIG. 1 that the upper segment 22A, middle of three center segments 22B and lower segment 22C have parallel orientation with the first and third center segments 22B having opposite orientations. FIGS. 2A-2D depict some of the variety of positions the segments 22 can adopt as a result of the wiggle motion imposed upon fidget toy 20.

While the first embodiment shown in FIGS. 1-4 are depicted as having a circular cross section, it will be understood that any of a plurality of other cross sections can be adopted. By way of example, FIGS. 5A-5D depict a hexagonal fidget toy 20'. This is but two of the options possible. In addition to round and hexagonal, the fidget toy 20 could be pentagonal, octagonal, or any of a variety of other shapes. In addition, the cylindrical version can take on the persona of a beer or other beverage can, a worm or other character of interest to children. In these first two embodiments, the total included angle for all of the segments for optimum "wiggling" is around 80° and not to exceed 82°. The worm, which is not a fidget toy, per se, can have 9 segments with facial features (i.e., a big eye) on each end.

In employing the fidget toy 20, the user grasps the end segments 22A and 22B between a pair of fingers supporting lower surface 32C and thumb supporting upper surface 32A, by squeezing thumb and fingers toward one another with some wiggling motion, the center segments 22B will rotate in a variety of rotational directions and squirm on the user's hand in a fascinating manner that entices continued use.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A stress-relieving fidget toy comprising:

a) a first plurality $P_1$ of interconnected wedge segments including an uppermost and a lowermost interconnected wedge segment and a second plurality $P_2$ of intermediate interconnected wedge segments;

b) each of said second plurality of wedge segments having a first end with an opening therein and a second closed end with connection means extending therefrom, said connecting means extending between adjacent ones of said first plurality of interconnected wedge segments;

c) circular bearing means press fit in each of said openings and surrounding each of said connection means, each said connecting means being press fit into its respective bearing means;

whereby exertion of opposing pressure on an uppermost and lowermost surface of said uppermost and said lowermost interconnected wedge segments will cause random rotation of said second plurality of intermediate wedge segments which in turn results in a serpentine wiggling of said first plurality of interconnected wedge segments.

2. The stress-relieving fidget toy of claim 1 wherein each of said second plurality $P_2$ of wedge segments has a wedge-included-angle $\alpha$ of between 15° and 25°.

3. The stress-relieving fidget toy of claim 2 wherein said uppermost and lowermost segments have a combined wedge-included-angle of $\alpha$.

4. The stress-relieving fidget toy of claim 3 wherein $(P_2+1)\alpha \leq 82°$.

5. The stress-relieving fidget toy of claim 1 wherein each of said first plurality $P_1$ of interconnected wedge segments is hexagonal in shape.

6. The stress-relieving fidget toy of claim 1 wherein each of said first plurality $P_1$ of interconnected wedge segments is round in shape.

* * * * *